US007832340B2

(12) United States Patent
Dorian et al.

(10) Patent No.: US 7,832,340 B2
(45) Date of Patent: Nov. 16, 2010

(54) HOPPER RAILCAR WITH AUTOMATIC INDIVIDUAL DOOR SYSTEM

(75) Inventors: Robert H Dorian, Johnstown, PA (US); Todd L Lydic, Johnstown, PA (US); Michael Selapack, Portage, PA (US)

(73) Assignee: Freightcar America, Inc., Johnstown, PA (US)

( * ) Notice: Subject to any disclaimer, the term of this patent is extended or adjusted under 35 U.S.C. 154(b) by 174 days.

(21) Appl. No.: 11/626,072

(22) Filed: Jan. 23, 2007

(65) Prior Publication Data

US 2007/0175357 A1 Aug. 2, 2007

Related U.S. Application Data

(60) Provisional application No. 60/761,686, filed on Jan. 24, 2006.

(51) Int. Cl.
*B61D 9/00* (2006.01)

(52) U.S. Cl. ..... 105/288

(58) Field of Classification Search ..... 105/238.1, 105/239, 247, 248, 280, 286, 288
See application file for complete search history.

(56) References Cited

U.S. PATENT DOCUMENTS

| | | | | |
|---|---|---|---|---|
| 1,418,907 | A | | 6/1922 | Campbell |
| 1,444,730 | A | | 2/1923 | Christianson |
| 1,584,436 | A | | 5/1926 | Cremean |
| 3,187,684 | A | | 6/1965 | Ortner |
| 3,596,609 | A | | 8/1971 | Ortner et al. |
| 3,608,500 | A | | 9/1971 | Floehr |
| 3,611,947 | A | | 10/1971 | Nagy |
| 3,654,873 | A | | 4/1972 | Floehr |
| 3,786,764 | A | | 1/1974 | Beers, Jr. et al. |
| 3,815,514 | A | | 6/1974 | Heap |
| 3,818,842 | A | * | 6/1974 | Heap ..... 105/240 |
| 3,949,681 | A | | 4/1976 | Miller |
| 4,163,424 | A | | 8/1979 | Lindauer |
| 4,222,334 | A | * | 9/1980 | Peterson ..... 105/250 |
| 4,224,877 | A | | 9/1980 | Stark et al. |
| 4,329,106 | A | * | 5/1982 | Adler ..... 414/388 |
| 4,366,757 | A | * | 1/1983 | Funk ..... 105/248 |
| 4,601,244 | A | | 7/1986 | Fischer |
| 4,741,274 | A | * | 5/1988 | Ferris et al. ..... 105/240 |
| 5,249,531 | A | * | 10/1993 | Taylor ..... 105/290 |
| 5,823,118 | A | | 10/1998 | M.ang.nstrom |
| 6,405,658 | B1 | | 6/2002 | Taylor |

* cited by examiner

*Primary Examiner*—S. Joseph Morano
*Assistant Examiner*—Robert J McCarry, Jr.
(74) *Attorney, Agent, or Firm*—Blynn L. Shideler; Krisanne Shideler; BLK Law Group

(57) ABSTRACT

The door operating system of the present invention can be applied to new railcar or retrofitted to existing railcar designs. The hopper car will have a pair of doors on opposed sides of the center sill which are connected through a door spreader. The pneumatic, individual door operating system is connected to the door spreader through an adjustable spreader fulcrum in which the sliding adjustment may add in a proper connection force or tension between the door operating system and the individual doors.

19 Claims, 3 Drawing Sheets

HOPPER RAILCAR WITH AUTOMATIC INDIVIDUAL DOOR SYSTEM

RELATED APPLICATION

This application claims the benefit of Provisional Application Ser. No. 60/761,686 entitled "Hopper Railcar with Automatic Individual Door System" filed Jan. 24, 2006.

BACKGROUND OF THE INVENTION

1. FIELD OF THE INVENTION

The present invention relates generally to a hopper railcar with an apparatus for opening the rotating discharge doors of the hopper railcar, and in particular, to an apparatus for automatically opening individual pairs of the rotating hopper car discharge doors.

2. BACKGROUND INFORMATION

A common type of railroad freight car in use today is the open top freight car of the type wherein the load may be discharged through hoppers on the underside of the body, which can be generally referred to as a hopper railcar or hopper car. Hopper cars are used to haul coal, grain, phosphate and other commodities. After hopper cars are positioned over an unloading pit, the discharge doors of the hoppers are rotated to an open position, allowing the material within the hopper car to be emptied into the pit. There are several methods available for opening and closing the hopper doors.

U.S. Pat. No. 3,596,609 describes a system for simultaneously opening rotating hopper doors of a hopper car using a longitudinally extending operating rod connected to actuating shafts extending transversely below the hopper car body. Each door operating lever rotates an actuating shaft which in turn actuates a linkage mechanism to open and close the doors.

U.S. Pat. No. 4,741,274 also describes a system for operating hopper doors on a railway hopper car. The lever is comprised of a single plate body portion with pivotal connections. The pivotal connections are coplanar with the door operating struts in a substantially vertical plan passing through the vertical transverse centerline of the center sill of the car to eliminate unnecessary rotational movements of the mechanism.

U.S. Pat. No. 5,249,531 discloses an effective actuating system for operating the doors of a railroad hopper car in which a plurality of levers for each hopper operate to rotate the doors of the hopper between an open and a closed position. The mechanism applies a tension force, rather than a compressive force, to push the doors closed. The mechanism also provides an over center latch to positively close each door.

U.S. Pat. No. 6,405,658 effectively discloses a modified individual manual version of the '531 patent design disclosing a manual discharge door operating system for a hopper railcar that includes a door actuation shaft coupled to the railcar extending across the width of the railcar. The door actuation shaft has distal ends accessible from opposite sides of the railcar with each distal end adapted to be engaged with a handle for manual rotation of the actuation shaft by the operator. Rotation of the actuation shaft opens and closes the discharge door of the hopper railcar through linkage assemblies. Preferably, a door operating linkage assembly is provided with an over-center closed position to hold the door in the closed position. The manual operation of these types of door systems can lead to injury to the operator.

Other prior art references that teach operating mechanisms for opening and closing hopper doors include U.S. Pat. No. 3,187,684; U.S. Pat. No. 3,611,947; U.S. Pat. No. 3,786,764; U.S. Pat. No. 3,815,514; U.S. Pat. No. 3,818,842; U.S. Pat. No. 3,949,681; U.S. Pat. No. 4,222,334; U.S. Pat. No. 4,366,757; U.S. Pat. No. 4,601,244; and U.S. Pat. No. 5,823,118. Further patents of interest include U.S. Pat. Nos. 1,418,907; 1,444,730; 1,584,436; 3,608,500; 3,654,873; 4,163,424; and 4,224,877.

There remains a need for safe efficient, effective, reliable automatic, individual door or door pair opening and closing system for hopper railcars.

SUMMARY OF THE INVENTION

It is noted that, as used in this specification and the appended claims, the singular forms "a," "an," and "the" include plural referents unless expressly and unequivocally limited to one referent.

For the purposes of this specification, unless otherwise indicated, all numbers expressing invention parameters used in the specification and claims are to be understood as being modified in all instances by the term "about." Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

All numerical ranges herein include all numerical values and ranges of all numerical values within the recited numerical ranges. Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements.

The various embodiments and examples of the present invention as presented herein are understood to be illustrative of the present invention and not restrictive thereof and are non-limiting with respect to the scope of the invention.

One embodiment of the present invention provides an individual door operating system for pairs of rotating doors of a hopper railcar. Although the door operating system of the present invention is primarily designed for traditional hopper, or even aggregate cars, but is not limited thereto. The door operating system of the present invention can be applied to new railcar or retrofitted to existing railcar designs. The hopper car will have a pair of doors on opposed sides of the center sill which are connected through a door spreader. The door operating system is connected to the door spreader through an adjustable spreader fulcrum in which the sliding adjustment may add in a proper connection force or tension between the door operating system and the individual doors.

The main body of the individual pneumatic door operating system according to the present invention can be completely preassembled. The completed assembly is mounted under the bottom surface of the railcar center sill and connected to the spreader fulcrum through a linkage arm. The main body essentially consists of mounting side frame angles, one double acting pneumatic cylinder rotationally mounted in the side frame angles with a slotted cylinder nose clevis applied to the end of the cylinder shaft, one cylinder lever rotationally attached to the side frame angles and to the slotted nose clevis, at least one door spreader lever extending between the cylinder lever and the spreader fulcrum, a secondary lock mounted on the side frame angles at a position that can engage with the door structure when the doors are in a closed position, an indicator on the side frame angles that indicates the status of the secondary door lock, a cylinder fulcrum pin for rotationally mounting the cylinder to the side frame angles, a cylinder lever fulcrum pin for rotationally mounting the door spreader lever to the cylinder lever, and a door fulcrum pin for rotationally mounting the door lever to the spreader fulcrum.

When air is channeled into the rear of the cylinder, the cylinder piston is extended, rotating the cylinder lever. As the cylinder lever rotates, the door lever rotates about the door spreader fulcrum and extends through the arc of the cylinder lever. The hopper doors pivot about a conventional door pivot (not shown in detail) via the motion of the cylinder lever and the door lever when the cylinder is fully extended, unloading the commodity within the pair of hopper pockets. When the air is directed into the forward end of the cylinder, exhausting the air in the rear end of the cylinder, the cylinder shaft retracts rotating the cylinder lever and pulling the doors closed. When the cylinder lever is fully retracted, the secondary lock is engaged. When the secondary lock is fully engaged, the secondary lock indicator is retracted indicating its engagement.

The individual automatic door operating system of the present invention can be activated by several different methods, examples of these are, air activated push buttons, electrically charged hot shoe or pads, mechanical linkages, and all known methods of activating the cars auxiliary air or way side air supply. The particular activation and control system is up to the individual user. It is anticipated that multiple door operating cylinders of the present invention may be selected to be operated together by the control. The linking of two or more door operating systems of the present invention do not make them less independent in that they can easily be designed for individual operation.

The present invention provides an effective efficient door operating system that can control the unloading by an individual hopper pocket (pair of doors), or all hoppers at once. The present system eliminates injury associated with manual individual door actuators. The present invention includes a double hopper door locking system, with the first being the cylinder and door lever's over center position, and the second being the secondary locking. The present invention provides simplicity of assembly for a new or retrofitting to a used or existing hopper car. These and other advantages of the present invention will be clarified in the description of the preferred embodiments taken together with the attached figures.

DESCRIPTION OF THE PREFERRED EMBODIMENT

Figure 1:
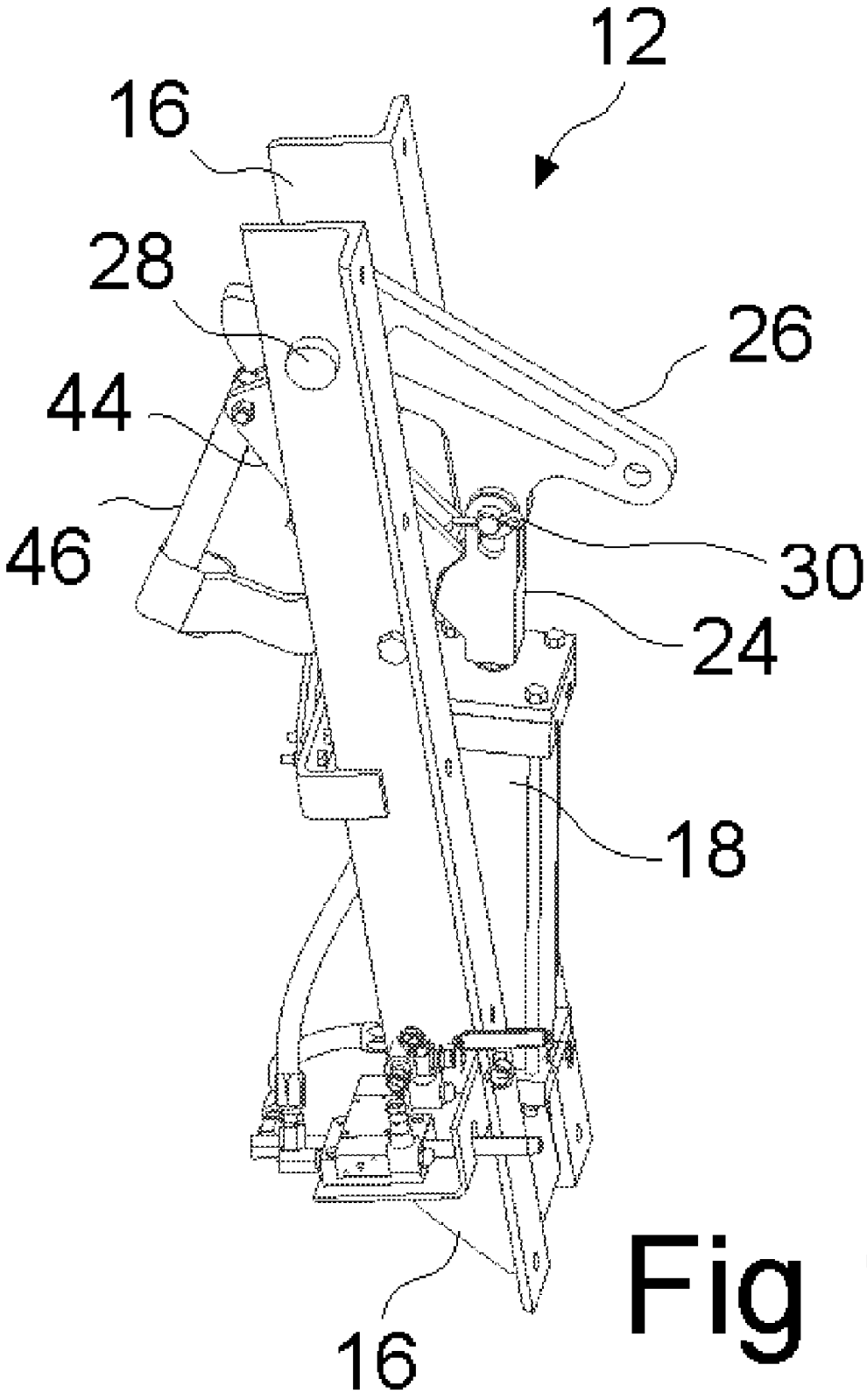
FIG. 1 is a schematic perspective view of a main body of an apparatus for automatically opening individual pairs of the rotating hopper car discharge doors according to the present invention.
Figure 2:
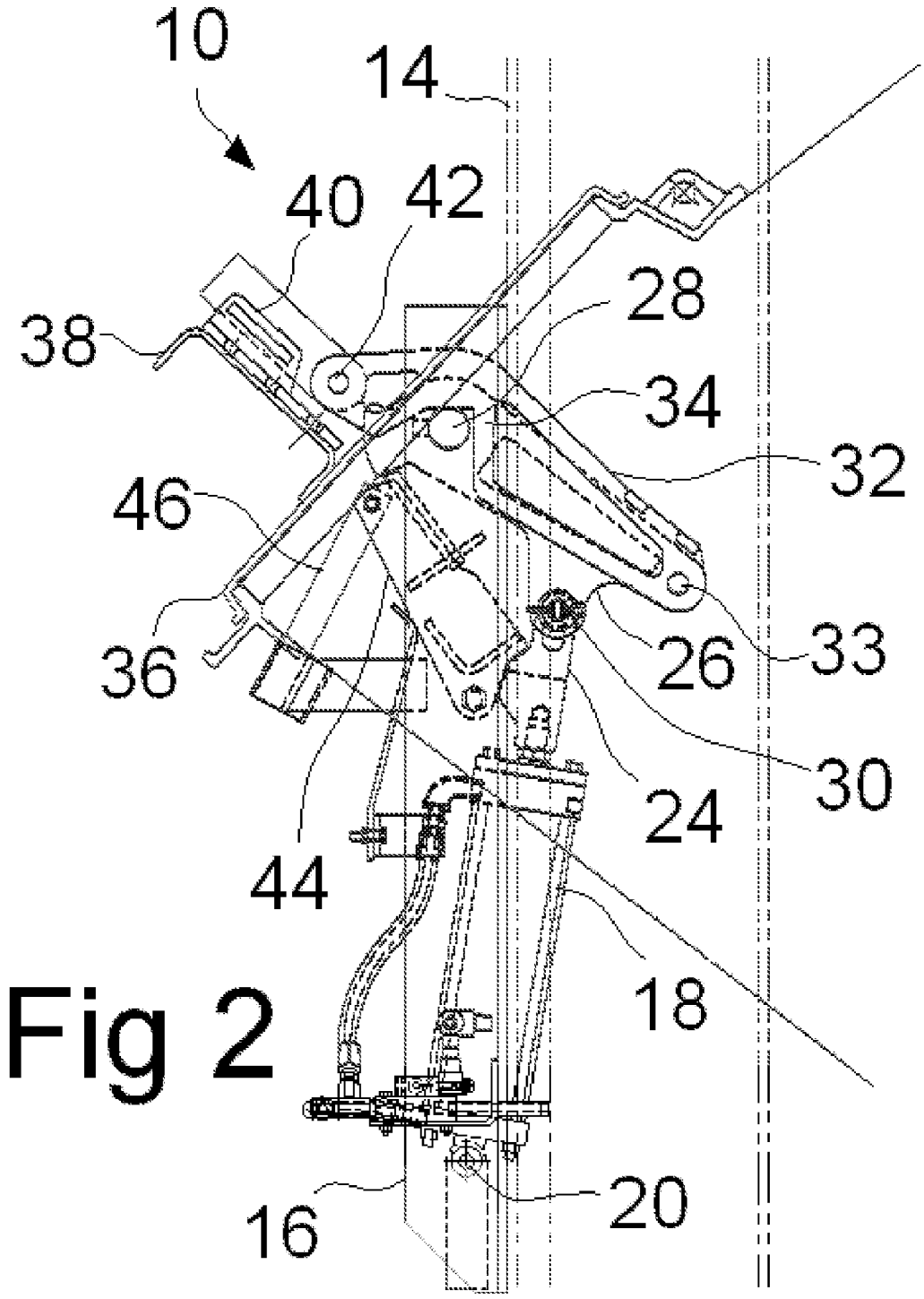
FIG. 2 is a schematic side view of the apparatus for automatically opening individual pairs of the rotating hopper car discharge doors according to the present invention of FIG. 1 with the doors in the closed position.
Figure 3:
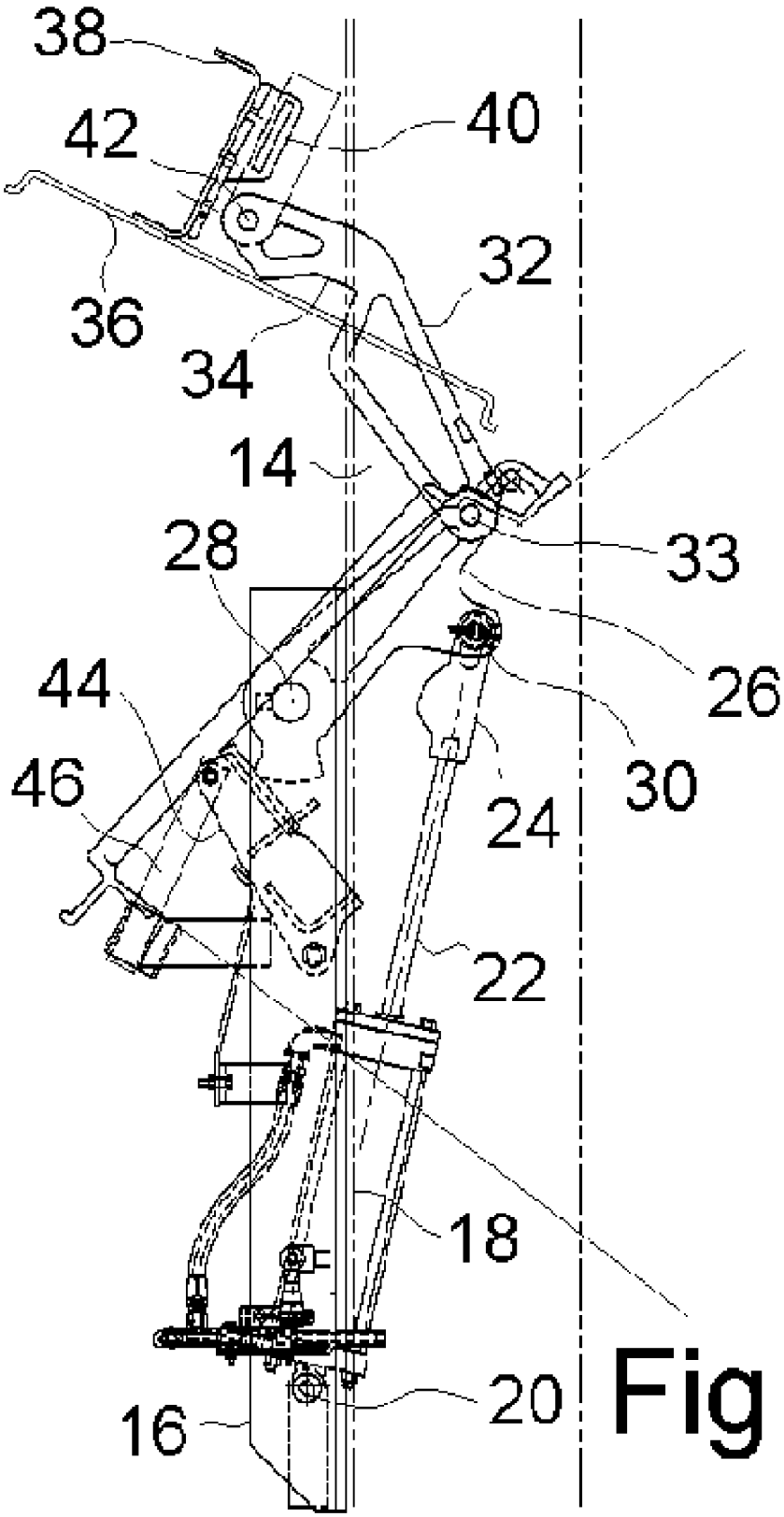
FIG. 3 is a schematic side view of the apparatus for automatically opening individual pairs of the rotating hopper car discharge doors according to the present invention of FIG. 1 with the doors in the open position.

The construction of a standard hopper railcar is well-known in the industry and is described in greater detail in the above cited patents, particularly U.S. Pat. Nos. 5,249,531 and 6,405,658, all of which are incorporated herein by reference. FIGS. 1-3 schematically illustrate the individual automatic railroad hopper door actuating mechanism 10 of the present invention. When discussing individual door actuation it is understood that typically the hopper construction will have a pair of doors on either side of the center sill, which is schematically illustrated as a single door in FIGS. 2 and 3.

The door actuating mechanism 10 includes a pre-assembled body 12 for each door pair with the body 12 mounted to a center sill 14 of the railcar through mounting side frame angles 16 of the body 12. The main body 12 includes one double acting pneumatic cylinder 18 rotationally mounted in the side frame angles 16 through a cylinder fulcrum pin 20. The piston or cylinder 18 includes an extending shaft 22 and a slotted cylinder nose clevis 24 applied to the end of the cylinder shaft 22. A cylinder lever 26 is rotationally attached to the side frame angles 16 through a fulcrum stop pin 28. The cylinder lever 26 is attached to the slotted nose clevis 24 through a pin 30. A least one door spreader lever 32 (shown in FIGS. 2-3) extends between the cylinder lever 26 and the door structure, described below. The lever 32 is rotationally coupled to the lever 26 through fulcrum pin 33, as shown in FIGS. 2-3. The lever 32 includes a cutout 34 which rests against the pin 28 in the over-center closed position shown in FIG. 2. The lever 32 with cut-out 34 and the over center position on the pin 28 are similar to the elements in prior door operating mechanism discussed in the U.S. Pat. Nos. 5,249,531 and 6,405,658. The present invention is specifically intended to maintain the same advantages provided by these elements discussed in these earlier door operating mechanism designs.

As noted above, the hopper car will have a pair of doors 36 on opposed sides of the center sill 14 which are connected through a door spreader 38. The door operating system 10 is connected to the door spreader 38 through an adjustable spreader fulcrum 40 in which the sliding adjustment may add in a proper connection force or tension between the door operating system and the individual doors. Specifically lever 32 is rotationally coupled to the spreader fulcrum 40 through pin 42.

A secondary lock 44 mounted on the side frame angles 16 at a position that can engage with the door structure when the doors 36 are in a closed position as shown in FIG. 2. An indicator 46 is mounted on the side frame angles 16 and will cooperate with the lock 44 to indicate the status of the secondary door lock 44.

The individual automatic door operating system 10 of the present invention can be activated by several different conventional methods, examples of these are, air activated push buttons, electrically charged hot shoe or pads, mechanical linkages, and all known methods of activating the car's auxiliary air or way side air supply. The particular activation and control system is up to the individual user. It is anticipated that multiple door operating cylinders of the present invention may be selected to be operated together by the control if desired. The linking of two or more door operating systems 10 of the present invention do not make them less independent in that they can easily be designed for individual operation. The independent structure of the door opening systems gives the user greater flexibility in operation.

In operation, when air is channeled into the rear of the cylinder 18, the cylinder piston 22 is extended, rotating the cylinder lever 26. As the cylinder lever 26 rotates, the door lever 32 rotates about the door spreader fulcrum 40 and extends through the arc of the cylinder lever 26. The hopper doors 36 pivot about a conventional door pivot structure (not shown in detail) via the cylinder lever 26 and the door lever 32 until the cylinder 18 is fully extended, unloading the commodity within the pair of hopper pockets. When the air is directed into the forward end of the cylinder 18, exhausting the air in the rear end of the cylinder 18, the cylinder shaft 22 retracts rotating the cylinder lever 26, and moving the door lever 32 and pulling the doors 36 closed. When the cylinder lever 26 is fully retracted, the secondary lock 44 is engaged. When the secondary lock 44 is fully engaged, the secondary lock indicator 46 is retracted indicating its engagement.

The railroad hopper door actuating mechanism 10 of the present invention is designed for safe, flexible, economical unloading of coal and other bulk materials from railroad cars. The railroad hopper door actuating mechanism 10 of the present invention maintains some of the advantages of earlier designs, while addressing some of the drawbacks with those systems.

The over-center door mechanism provides simple operation and reduces the possibility of injury to the operator with the automatic operation. The system requires minimal readjustment or maintenance. Additionally, if the railcar is operated in rotary discharge operation, the dual locking railroad hopper door actuating mechanism 10 of the present invention will maintain the hopper doors closed during the rotary dumping. The system can be easily retrofitted into existing railcars, even cars with worn or damaged doors or that have uneven door spacing.

Whereas particular embodiments of this invention have been described above for purposes of illustration, it will be evident to those skilled in the art that numerous variations of the details of the present invention may be made without departing from the invention as defined in the appended claims. The present invention is not intended to be restricted to the particular embodiments disclosed. For example, the door operating mechanism can be designed to open a double set of door pans. This modification of the door operating linkage is shown in the earlier '531 patent. Further modifications are within the scope of the present invention. The specific scope of the present invention is defined in the appended claims and equivalents thereto.

What is claimed is:

1. A hopper railcar comprising:

A plurality of hopper sections spaced along a center sill of the railcar, wherein each hopper section has a pair of hopper doors positioned on opposites sides of the center sill, wherein the hopper doors pivot between an open and closed position; and A plurality of automatic railroad hopper door actuating mechanisms, each mechanism including a single actuating piston/cylinder associated with at least one pair of hopper doors, each mechanism including:

i) a frame mounted to the center sill, ii) said actuating piston/cylinder rotationally mounted to the frame and configured to rotate about a rotational axis that is substantially perpendicular to the center sill, iii) a cylinder lever rotationally mounted to the frame, the cylinder lever coupled to and rotated by the piston/cylinder and configured to rotate about a rotational axis that is substantially perpendicular to the center sill, and iv) a door lever extending between the cylinder lever and the hopper doors for opening and closing the doors through actuation of the piston/cylinder.

2. The hopper railcar of claim 1 further including a lock engaging each hopper door when the door is in the closed position.

3. The hopper railcar of claim 1 wherein the frame of each automatic railroad hopper door actuating mechanism comprises a pair of side frame angles extending along and coupled to the center sill.

4. The hopper railcar of claim 3 wherein the piston/cylinder of each automatic railroad hopper door actuating mechanism comprises a double acting pneumatic cylinder rotationally mounted in the side frame angles through a cylinder fulcrum pin that extends perpendicular to the center sill.

5. The hopper railcar of claim 3 wherein the cylinder lever of each automatic railroad hopper door actuating mechanism is rotationally attached to the side frame angles through a fulcrum stop pin that extends perpendicular to the center sill.

6. The hopper railcar of claim 5 wherein the door lever of each automatic railroad hopper door actuating mechanism includes a cutout which rests against the pin in the over-center closed position.

7. An automatic railroad hopper door actuating mechanism including a single actuating piston/cylinder for operating at least one pair of hopper doors of a hopper railcar, the mechanism comprising:

A frame configured to be mounted to a center sill of the railcar;

said actuating piston/cylinder rotationally mounted to the frame and configured to rotate about a rotational axis that is substantially perpendicular to the center sill;

A cylinder lever rotationally mounted to the frame, the cylinder lever coupled to and rotated by the piston/cylinder and configured to rotate about a rotational axis that is substantially perpendicular to the center sill; and A door lever coupled to the cylinder lever and configured to be coupled to the hopper doors for opening and closing the doors through actuation of the piston/cylinder.

8. The automatic railroad hopper door actuating mechanism of claim 7 further including a lock engaging each hopper door when the door is in the closed position.

9. The automatic railroad hopper door actuating mechanism of claim 7 wherein the frame comprises a pair of side frame angles extending along and coupled to the center sill.

10. The automatic railroad hopper door actuating mechanism of claim 9 wherein the piston/cylinder comprises a double acting pneumatic cylinder rotationally mounted in the side frame angles through a cylinder fulcrum pin that extends perpendicular to the center sill.

11. The automatic railroad hopper door actuating mechanism of claim 9 wherein the cylinder lever is rotationally attached to the side frame angles through a fulcrum stop pin that extends perpendicular to the center sill.

12. The automatic railroad hopper door actuating mechanism of claim 11 wherein the door lever includes a cutout which rests against the pin in the over-center closed position.

13. A method of retrofitting a railcar having a plurality of hopper sections spaced along a center sill of the railcar, wherein each hopper section has a pair of hopper doors positioned on opposites sides of the center sill, wherein the hopper doors pivot between an open and closed position, the method comprising the steps of:

A) Providing at least one automatic railroad hopper door actuating mechanism including a single actuating piston/cylinder for operating at least one pair of hopper doors of a hopper railcar, the mechanism comprising:

i) A frame configured to be mounted to a center sill of the railcar;

ii) said actuating piston/cylinder rotationally mounted to the frame and configured to rotate about a rotational axis that is substantially perpendicular to the center sill;

iii) A cylinder lever rotationally mounted to the frame, the cylinder lever coupled to and rotated by the piston/cylinder and configured to rotate about a rotational axis that is substantially perpendicular to the center sill; and iv) A door lever coupled to the cylinder lever and configured to be coupled to the hopper doors for opening and closing the doors through actuation of the piston/cylinder;

B) Mounting the frame to the center sill of the railcar; and

C) Attaching the door lever to the hopper doors of the railcar.

14. The method of retrofitting a railcar of claim 13 further including providing a lock engaging each hopper door when the door is in the closed position.

15. The method of retrofitting a railcar of claim 13 wherein the frame for each automatic railroad hopper door actuating mechanism comprises a pair of side frame angles extending along and coupled to the center sill.

16. The method of retrofitting a railcar of claim 15 wherein the piston/cylinder for each automatic railroad hopper door actuating mechanism comprises a double acting pneumatic cylinder rotationally mounted in the side frame angles through a cylinder fulcrum pin that extends perpendicular to the center sill.

17. The method of retrofitting a railcar of claim 15 wherein the cylinder lever for each automatic railroad hopper door actuating mechanism is rotationally attached to the side frame angles through a fulcrum stop pin that extends perpendicular to the center sill.

18. The method of retrofitting a railcar of claim 17 wherein the door lever for each automatic railroad hopper door actuating mechanism includes a cutout which rests against the pin in the over-center closed position.

19. The method of retrofitting a railcar of claim 13 further including the step of removing an existing door operating mechanism from the railcar.

* * * * *